US011878198B2

(12) United States Patent
Shao

(10) Patent No.: US 11,878,198 B2
(45) Date of Patent: Jan. 23, 2024

(54) PORTABLE DUMBBELL

(71) Applicant: Hui Shao, Huizhou (CN)

(72) Inventor: Hui Shao, Huizhou (CN)

(73) Assignee: Hui Shao, Huizhou (CN)

( * ) Notice: Subject to any disclaimer, the term of this patent is extended or adjusted under 35 U.S.C. 154(b) by 245 days.

(21) Appl. No.: 17/368,833

(22) Filed: Jul. 7, 2021

(65) Prior Publication Data

US 2021/0331022 A1 Oct. 28, 2021

Related U.S. Application Data

(63) Continuation of application No. PCT/CN2019/089345, filed on May 30, 2019.

(51) Int. Cl.

| | |
|---|---|
| ***A63B 21/072*** | (2006.01) |
| ***A63B 21/075*** | (2006.01) |
| ***A63B 21/00*** | (2006.01) |
| ***A63B 71/00*** | (2006.01) |

(52) U.S. Cl.

CPC ..... *A63B 21/0726* (2013.01); *A63B 21/0004* (2013.01); *A63B 21/00061* (2013.01); *A63B 21/075* (2013.01); *A63B 21/0728* (2013.01); *A63B 71/0036* (2013.01)

(58) Field of Classification Search

CPC ..... A63B 21/0726; A63B 21/0004; A63B 21/00061; A63B 21/0728; A63B 71/0036; A63B 21/072–075

See application file for complete search history.

(56) References Cited

U.S. PATENT DOCUMENTS 850,964 A * 4/1907 Pelletier et al. ..... A63B 21/075 482/108
4,482,151 A 11/1984 Zwilling
9,327,159 B1 * 5/2016 Medina ..... A63B 21/0726
(Continued)

FOREIGN PATENT DOCUMENTS

CN 205667698 U 11/2016
CN 206152171 U 5/2017
(Continued)

OTHER PUBLICATIONS

Translation of CN215275598 (Year: 2021).*

*Primary Examiner* — Joshua Lee
*Assistant Examiner* — Catrina A Letterman
(74) *Attorney, Agent, or Firm* — HZRW0101NUS

(57) ABSTRACT

A portable dumbbell includes a handle connection rod, a balance weight seat, a balance weight lock structure and a balance weight, where the handle connection rod includes a handle and a connection rod, the handle being fixedly or detachably mounted on the connection rod, the balance weight seat is fixedly or detachably mounted at two ends of the connection rod, at least one assembly hole is provided on the balance weight seat and used for assembling the balance weight, and the balance weight lock structure is fixedly or detachably mounted at the two ends of the connection rod, is partially accommodated inside the balance weight seat, and is used for controlling the balance weight to be rapidly mounted and locked and unlocked and taken out. According to the portable dumbbell, the balance weight seat and the balance weight lock structure are arranged to match each other.

7 Claims, 5 Drawing Sheets

(56) References Cited

U.S. PATENT DOCUMENTS

| | | | | |
|---|---|---|---|---|
| 9,717,943 | B2 | 8/2017 | Klonoski | |
| 9,795,822 | B2 | 10/2017 | Smith et al. | |
| 2004/0067826 | A1* | 4/2004 | Elledge | A63B 21/075 482/141 |
| 2013/0231225 | A1* | 9/2013 | Shozda | A63B 21/075 482/108 |
| 2017/0274240 | A1* | 9/2017 | Pong | A63B 21/4035 |
| 2019/0388724 | A1* | 12/2019 | Polinsky | A63B 24/0087 |
| 2022/0040520 | A1* | 2/2022 | Tran | A63B 21/0726 |
| 2022/0054879 | A1* | 2/2022 | Zhang | A63B 21/0728 |
| 2022/0062683 | A1* | 3/2022 | Zhang | A63B 21/0722 |
| 2022/0062686 | A1* | 3/2022 | Zhang | A63B 21/075 |
| 2022/0401786 | A1* | 12/2022 | Zhang | A63B 21/0728 |

FOREIGN PATENT DOCUMENTS

| | | | | |
|---|---|---|---|---|
| CN | 207203297 U | | 4/2018 | |
| CN | 208176813 U | | 12/2018 | |
| CN | 215275598 | * | 12/2021 | A63B 21/075 |
| GB | 2413288 | * | 4/2004 | A63B 21/075 |
| KR | 101233360 B1 | | 2/2013 | |

* cited by examiner

PORTABLE DUMBBELL

CROSS-REFERENCE TO RELATED APPLICATIONS

This application is a continuation of International Patent Application No. PCT/CN2019/089345 with a filing date of May 30, 2019, designating the United States, and further claims priority to Chinese Patent Application No. 201910370164.6 with a filing date of May 6, 2019. The content of the aforementioned applications, including any intervening amendments thereto, are incorporated herein by reference.

TECHNICAL FIELD

The present disclosure relates to the technical field of fitness equipment, in particular to a portable dumbbell.

BACKGROUND OF THE PRESENT INVENTION

Dumbbells assist in weight lifting and body building, and are named this way for its noiselessness during use.

As a simple device for muscle strength enhancement training, dumbbells are mainly made of cast iron, some of which being covered with rubber. They are used for muscle strength training and compound muscle action training. For example, patients with low muscle strength due to motor paralysis, pain, long-term inactivity, etc. can hold dumbbells and use the weight of dumbbells to perform anti-resistance active movement, so as to train muscle strength. Long-term exercise with dumbbells can forge muscle lines and increase muscle endurance. Frequent exercise with heavy dumbbells can build up muscles, intensify muscle fibers and increase muscle strength.

At present, dumbbells with fixed weight and adjustable weight are available. Weight-adjustable dumbbells are usually equipped with multiple balance weights of different weights. As required by users, balance weights of appropriate weights can be mounted for body-building exercise. However, when mounting the balance weights, users need to unscrew nuts, mount balance weights and then screw nuts, which is complicated. The mounting or dismounting process is time-consuming and inefficient.

SUMMARY OF PRESENT INVENTION

Based on that, it is necessary to provide a portable dumbbell with a balance weight mounted and dismounted rapidly.

The portable dumbbell includes a handle connection rod, a balance weight seat, a balance weight lock structure and a balance weight, where the handle connection rod includes a handle and a connection rod, the handle being fixedly or detachably mounted on the connection rod, the balance weight seat is fixedly or detachably mounted at two ends of the connection rod, at least one assembly hole is provided on the balance weight seat and used for assembling the balance weight, and the balance weight lock structure is fixedly or detachably mounted at the two ends of the connection rod, is partially accommodated inside the balance weight seat, and is used for controlling the balance weight to be rapidly mounted and locked and unlocked and taken out.

In one embodiment, the balance weight lock structure includes a rotary switch, a fixed shaft, a weight fastener and a first elastic member, where a stop block is arranged on the rotary switch, the rotary switch is sleeved on the two ends of the connection rod, the fixed shaft is fixedly mounted on the balance weight seat, the weight fastener is mounted on the fixed shaft, one end of the weight fastener abuts against the stop block, one end of the first elastic member is mounted on the weight fastener, and the other end thereof abuts against an inner layer of the balance weight seat.

In one embodiment, the balance weight lock structure includes a rotary shaft, a support seat, a limiting member and a mounting cap, where one end of the rotary shaft is fixedly or detachably mounted on the connection rod, the support seat is connected to the rotary shaft by threads, the limiting member is fixedly or detachably mounted on the support seat, the mounting cap is connected to the rotary shaft by threads, one end of the mounting cap abuts against the limiting member, and several pressing corners are arranged on the limiting member.

In one embodiment, one end of the balance weight is provided with a groove, and the end of the balance weight close to the handle is of a cambered surface structure or an inclined surface structure.

In one embodiment, the side of the weight fastener away from the first elastic member is of an inclined surface structure or a cambered surface structure.

In one embodiment, the balance weight lock structure further includes a second elastic member, a limiting part is arranged on the balance weight seat, and the second elastic member is sleeved on the connection rod and abuts against the limiting part of the balance weight seat and the rotary switch respectively.

In one embodiment, the balance weight lock structure further includes a limiting column, a first gap is provided on the rotary switch, and the limiting column is fixedly or detachably mounted on the balance weight seat and is accommodated inside the first gap.

In one embodiment, the portable dumbbell further includes a third elastic member, where the third elastic member is fixedly mounted on the balance weight seat and abuts against one end of the balance weight.

In one embodiment, two ends of the handle are each provided with a second gap, and a third gap matching the second gap is provided on an inner layer of the rotary switch.

In one embodiment, the balance weight seat is of at least one of a spherical structure, a cylindrical structure and a polygonal structure.

According to the portable dumbbell, the balance weight seat and the balance weight lock structure are arranged to match each other. When the dumbbell is needed for body building exercise, the balance weight with a needed weight is mounted into the assembly hole, and the balance weight lock structure clamps the balance weight inside the assembly hole, thereby preventing falling off, and when the balance weight needs to be replaced, the balance weight lock structure is used for unlocking the balance weight, so as to take the balance weight out from the assembly hole, which are simple and convenient, save time and improve efficiency.

DETAILED DESCRIPTION OF PREFERRED EMBODIMENTS

To enable the objectives, features, and advantages mentioned above of the present disclosure to be more apparent and easily understood, particular embodiments of the present disclosure will be described in detail below with reference to the drawings. Many specific details are set forth in the following description to facilitate full understanding of the present disclosure. However, the present disclosure may be implemented in many other ways different from those described herein, similar improvements may be made by those skilled in the art without departing from the connotation of the present disclosure, and therefore the present disclosure is not limited by the specific embodiments disclosed below.

It should be illustrated that when an element is referred to as being "fixed to" or "arranged on" another element, the element may be directly on another element or there may be an intermediate element. When an element is considered to be "connected" to another element, the element may be directly connected to another element or there may be an intermediate element simultaneously. The terms "vertical", "horizontal", "left", and "right" and similar expressions used herein are just for illustrative purposes, and do not mean sole implementations.

Unless otherwise defined, all technical and scientific terms used herein have the same meaning as commonly understood by those skilled in the technical field of the present disclosure. The terms used in the specification of the present disclosure herein are just for the purpose of describing particular embodiments, and are not intended to limit the present disclosure. The term "and/or" used herein includes any and all combinations of one or more related items listed.

Figure 1:
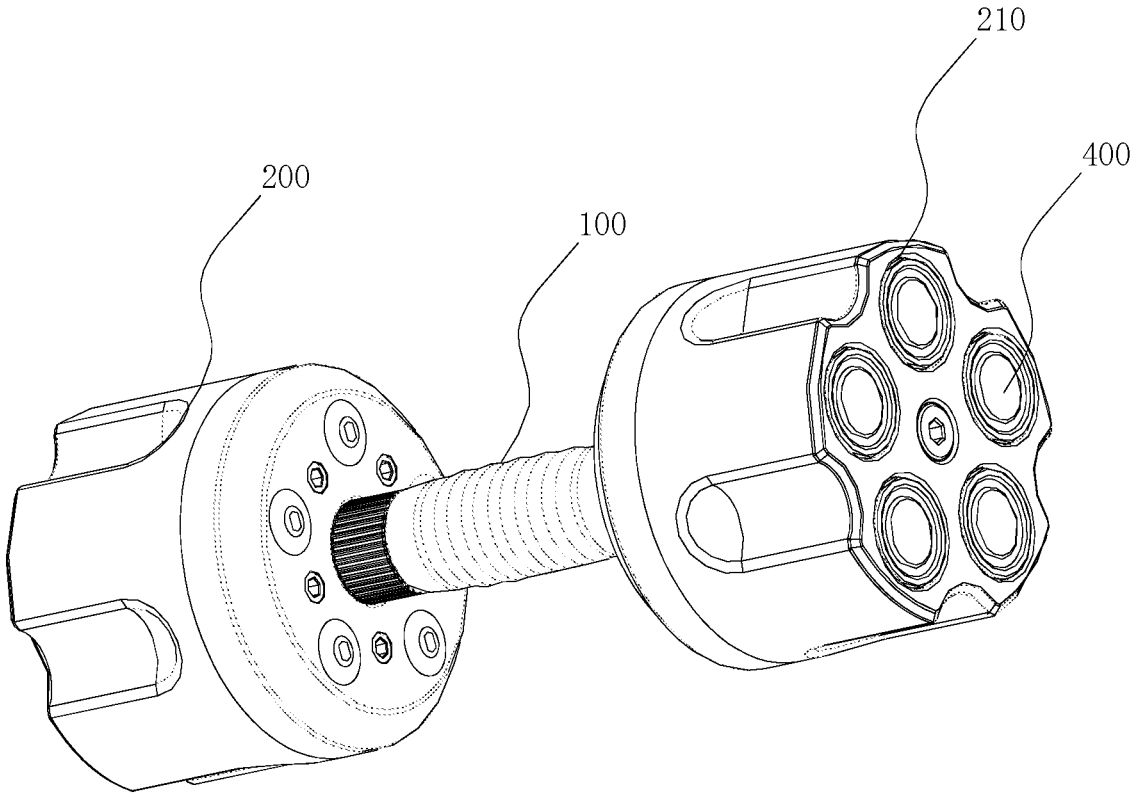
FIG. 1 is a schematic diagram of an assembly structure of a portable dumbbell of one embodiment of the present disclosure.
Figure 2:
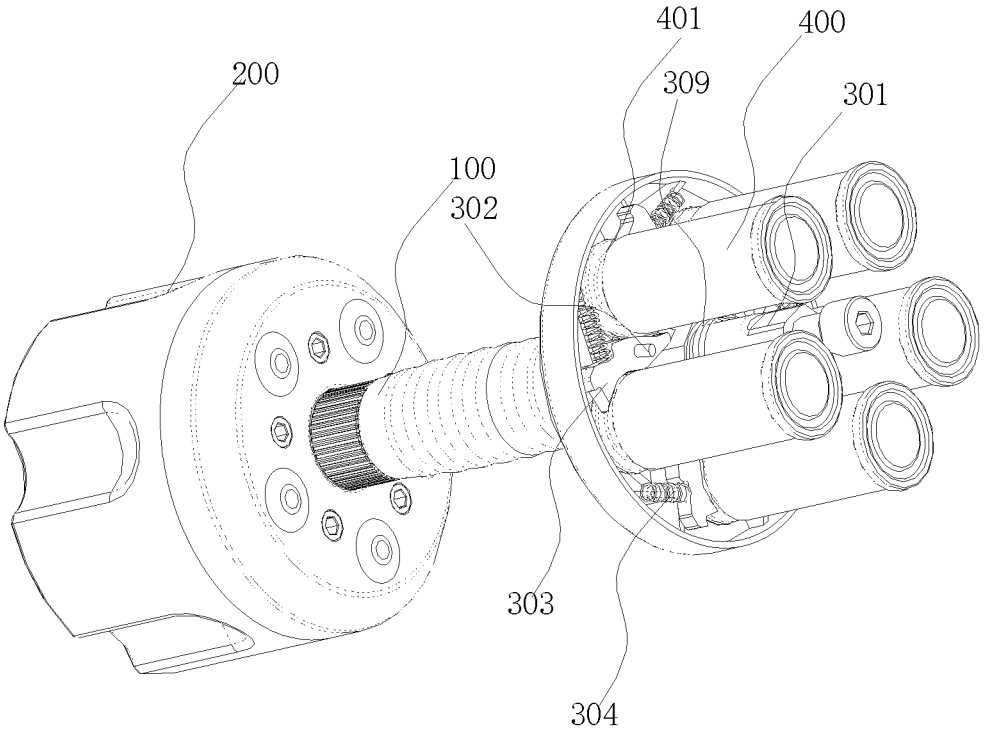
FIG. 2 is a schematic diagram of a locking structure in one angle of the portable dumbbell of one embodiment of the present disclosure of FIG. 1.
Figure 3:
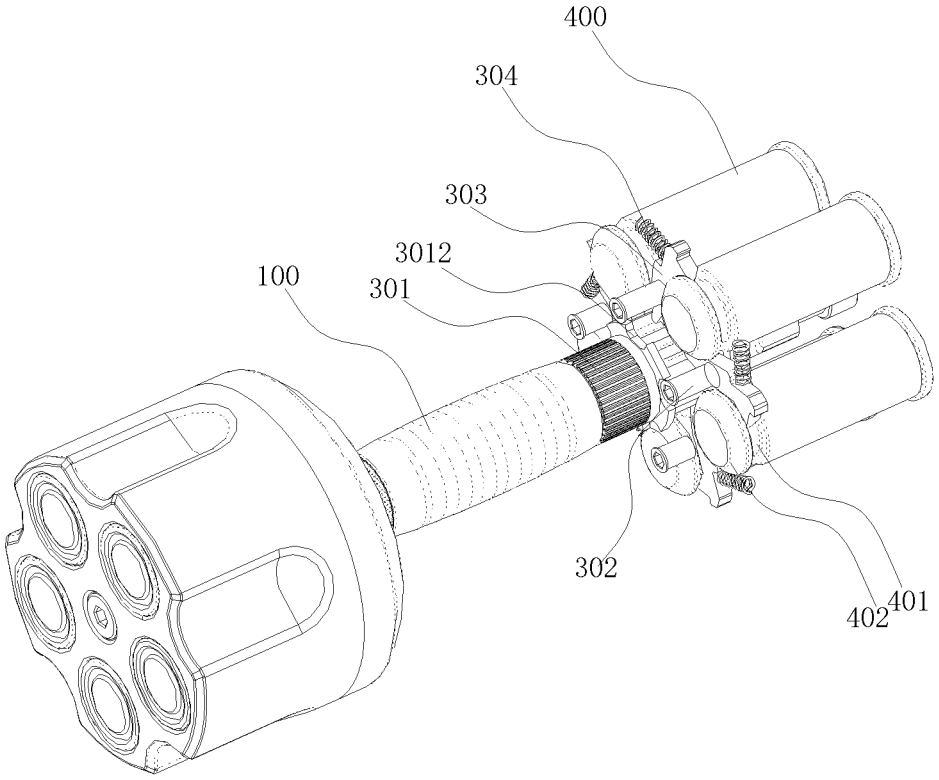
FIG. 3 a schematic diagram of a locking structure in another angle of the portable dumbbell of one embodiment of the present disclosure of FIG. 1.
Figure 4:
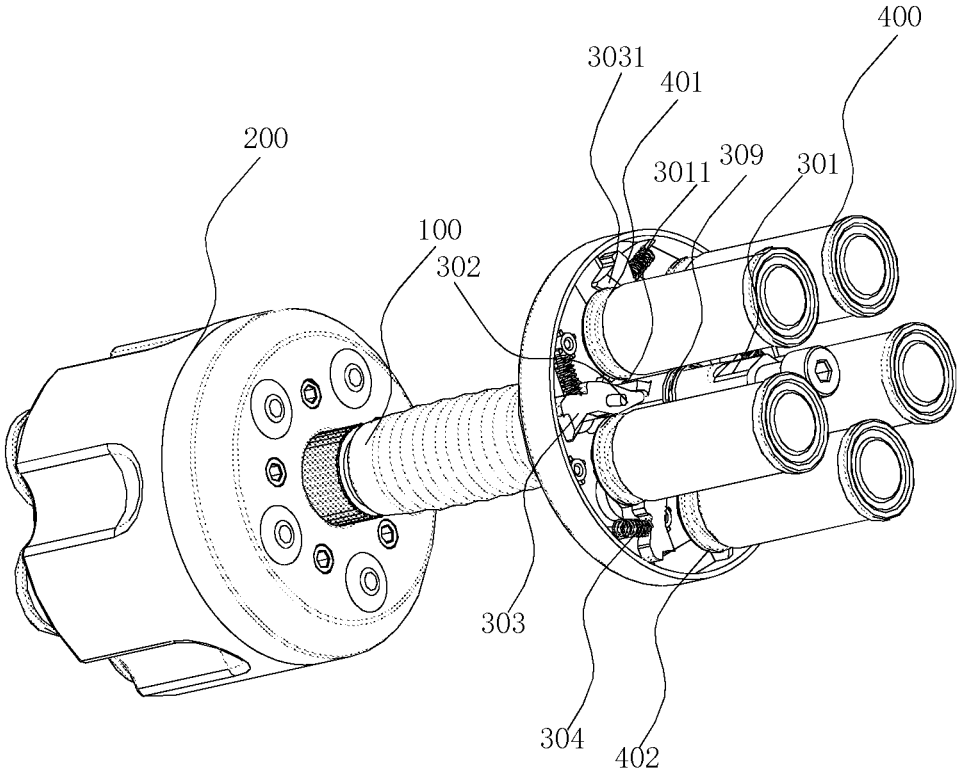
FIG. 4 is a schematic diagram of an open structure of the portable dumbbell of one embodiment of the present disclosure of FIG. 1.
Figure 8:
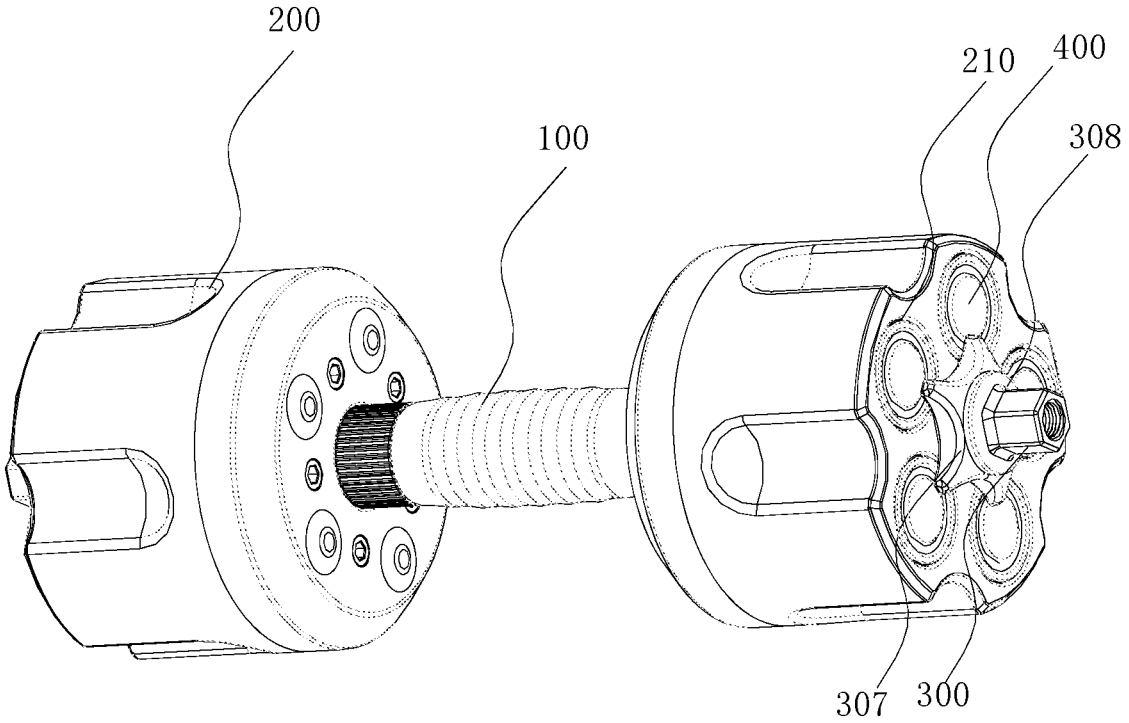
FIG. 8 is a schematic diagram of an assembly structure of a portable dumbbell of another embodiment of the present disclosure.

As shown in FIG. 1 or 8, a portable dumbbell includes a handle connection rod 100, a balance weight seat 200, a balance weight lock structure 300 and a balance weight 400, where the handle connection rod 100 includes a handle 110 and a connection rod 120, the handle 110 being fixedly or detachably mounted on the connection rod 120, the balance weight seat 200 is fixedly or detachably mounted at two ends of the connection rod 120, at least one assembly hole 210 is provided on the balance weight seat 200 and used for assembling the balance weight 400, and the balance weight lock structure 300 is fixedly or detachably mounted at the two ends of the connection rod 120, is partially accommodated inside the balance weight seat 200, and is used for controlling the balance weight 400 to be rapidly mounted and locked and unlocked and taken out.

When fitness training with the dumbbell is carried out, the balance weight 400 with a needed weight is mounted into the assembly hole 210, then the balance weight 400 is fixed inside the assembly hole 210 by means of the balance weight lock structure 300, thereby carrying out fitness training with the dumbbell. When the balance weight 400 needs to be replaced, the balance weight lock structure 300 is used for unlocking the balance weight 400 so as to take the balance weight 400 out from the assembly hole 210, thereby completing replacement of the balance weight 400.

In this way, in the case of the portable dumbbell, the balance weight seat 200 and the balance weight lock structure 300 are arranged to match each other. When the dumbbell is needed for body building exercise, the balance weight 400 with the needed weight is mounted into the assembly hole 210, and the balance weight lock structure 300 clamps the balance weight 400 inside the assembly hole 210, thereby preventing falling off, and when the balance weight 400 needs to be replaced, the balance weight lock structure 300 is used for unlocking the balance weight 400, so as to take the balance weight 400 out from the assembly hole 210, which are simple and convenient, save time and improve efficiency.

As shown in FIGS. 2, 3, 4 and 5, further, in order to mount the balance weight 400 mounted into or take it out from the assembly hole 210 more rapidly, the balance weight lock structure 300 includes a rotary switch 301, a fixed shaft 302, a weight fastener 303 and a first elastic member 304, where a stop block 3011 is arranged on the rotary switch 301, the rotary switch 301 is sleeved on the two ends of the connection rod 120, the fixed shaft 302 is fixedly mounted on the balance weight seat 200, the weight fastener 303 is mounted on the fixed shaft 302, one end of the weight fastener abuts against the stop block 3011, one end of the first elastic member 304 is mounted on the weight fastener 303, the other end thereof abuts against an inner layer of the balance weight seat 200, the balance weight 400 is of a cylindrical structure, one end of the balance weight is provided with a groove 401, the end of the balance weight close to the handle 110 is of a cambered surface structure or an inclined surface structure, and the side of the weight fastener 303 away from the first elastic member 304 is of an inclined surface structure or a cambered surface structure 3031.

Embodiment 1: the groove 401 is provided on the balance weight 400; when fitness training with the dumbbell is carried out, the balance weight 400 with the needed weight is firstly mounted into the assembly hole 210, the balance weight 400 is of the cylindrical structure, and under an action of self gravity or external force of the balance weight 400, the cambered surface or inclined surface structure of the balance weight 400 extrudes the inclined surface structure or cambered surface structure 3031 of the weight fastener 303 and pushes the weight fastener 303 away, such that the weight fastener 303 falls into the groove 401 of the balance weight 400 under the action of elastic force of recovering the first elastic member 304 from deformation, and the balance weight 400 is locked by the weight fastener 303 to fix the balance weight 400 inside the assembly hole 210, thereby preventing falling off, and fitness training with the dumbbell may be carried out; and when the balance weight 400 needs to be replaced, the rotary switch 301 rotates by a first preset angle clockwise or anticlockwise, the stop block 3011 on the rotary switch 301 rotates by the first preset angle at the same time, thereby driving the end of the fastener 303 close to the rotary switch 301 to rotate to make the other end of the fastener 303 away from the groove 401 of the balance weight 400 until the weight fastener 303 is separated from the groove 401, so as to take the balance weight 400 out from the assembly hole 210, and meanwhile, the first elastic member 304 is compressed, and when the rotary switch 301 is released, the first elastic member 304 needs to recover from the deformation to drive the weight fastener 303 to recover to a preset position.

In this way, the rotary switch 301, the weight fastener 303 and the first elastic member 304 are arranged to match one another; rotation of the rotary switch 301 makes the weight fastener 303 clamped into or leave the groove of the balance weight 400; when the balance weight 400 needs to be locked, under the action of the self gravity or the external force of the balance weight 400, the cambered surface or inclined surface structure of the balance weight 400 extrudes the inclined surface or the cambered surface structure of the weight fastener 303 and pushes the weight fastener 303 away, such that the weight fastener 303 falls into the groove 401 of the balance weight 400 under the action of the elastic force of recovering the first elastic member 304 from the deformation; and when the balance weight 400 needs to be taken out, the rotary switch 301 rotates by the first preset angle clockwise or anticlockwise, and the stop block 3011 on the rotary switch 301 rotates by the first preset angle at the same time, thereby driving the end of the fastener 303 close to the rotary switch 301 to rotate to make the other end of the fastener 303 away from the groove 401 of the balance weight 400 until the weight fastener 303 is separated from the groove 401, so as to take the balance weight 400 out from the assembly hole 210. The dumbbell is simple in structure and convenient to use.

Figure 9:
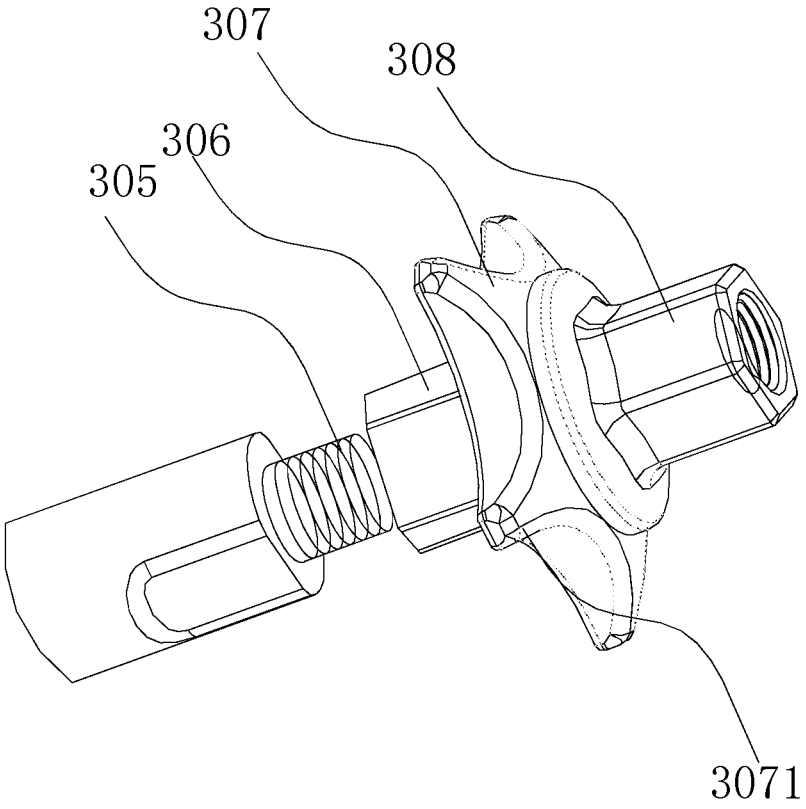
FIG. 9 is a structural schematic diagram of a balance weight lock structure of the portable dumbbell of another embodiment of the present disclosure of FIG. 8.

As shown in FIG. 9, further, the balance weight lock structure 300 includes a rotary shaft 305, a support seat 306, a limiting member 307 and a mounting cap 308, where one end of the rotary shaft 305 is fixedly or detachably mounted on the connection rod 120, the support seat 306 is connected to the rotary shaft 305 by threads, the limiting member 307 is fixedly or detachably mounted on the support seat 306, the mounting cap 308 is connected to the rotary shaft 305 by threads, one end of the mounting cap abuts against the limiting member 307, and several pressing corners 3071 are arranged on the limiting member 307.

Embodiment 2: when fitness training with the dumbbell is carried out, the balance weight 400 with the needed weight is mounted into the assembly hole 210 to make the end of balance weight 400 away from the handle 110 flush with the assembly hole 210, and the limiting member 307 is rotated, thereby driving the support seat 306 to rotate by a preset angle anticlockwise or clockwise on the rotary shaft 305 to press the pressing corner 3071 on the balance weight 400, thereby carrying out fitness training with the dumbbell. When the balance weight 400 needs to be replaced, the limiting member 307 is rotated, thereby driving the support seat 306 to rotate by the preset angle on the rotary shaft 305 anticlockwise or clockwise to move the pressing corner 3071 away from the balance weight 400, thereby taking the balance weight 400 out from the assembly hole 210.

In this way, the support seat 306 and the limiting member 307 are arranged to match each other, the limiting member 307 is rotated, thereby driving the pressing corner 3071 to press the balance weight 400 inside the assembly hole 210, or to be moved away from the balance weight 400 so as to take out the balance weight 400 from the assembly hole 210, which is simple and convenient, and the balance weight 400 may be rapidly mounted into or taken out from the assembly hole 210.

Figure 5:
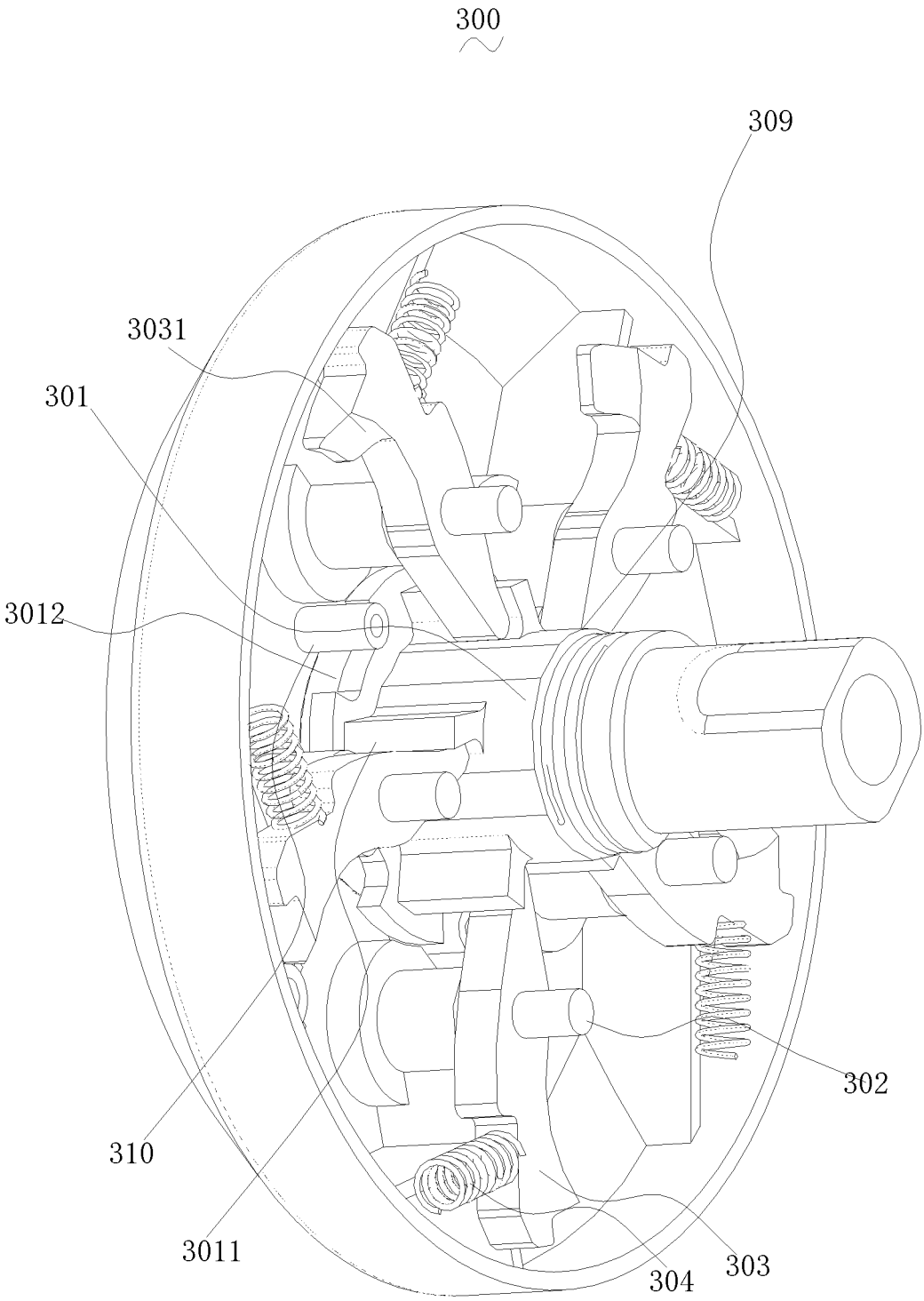
FIG. 5 is a structural schematic diagram of a balance weight lock structure of the portable dumbbell of one embodiment of the present disclosure of FIG. 1.
Figure 7:
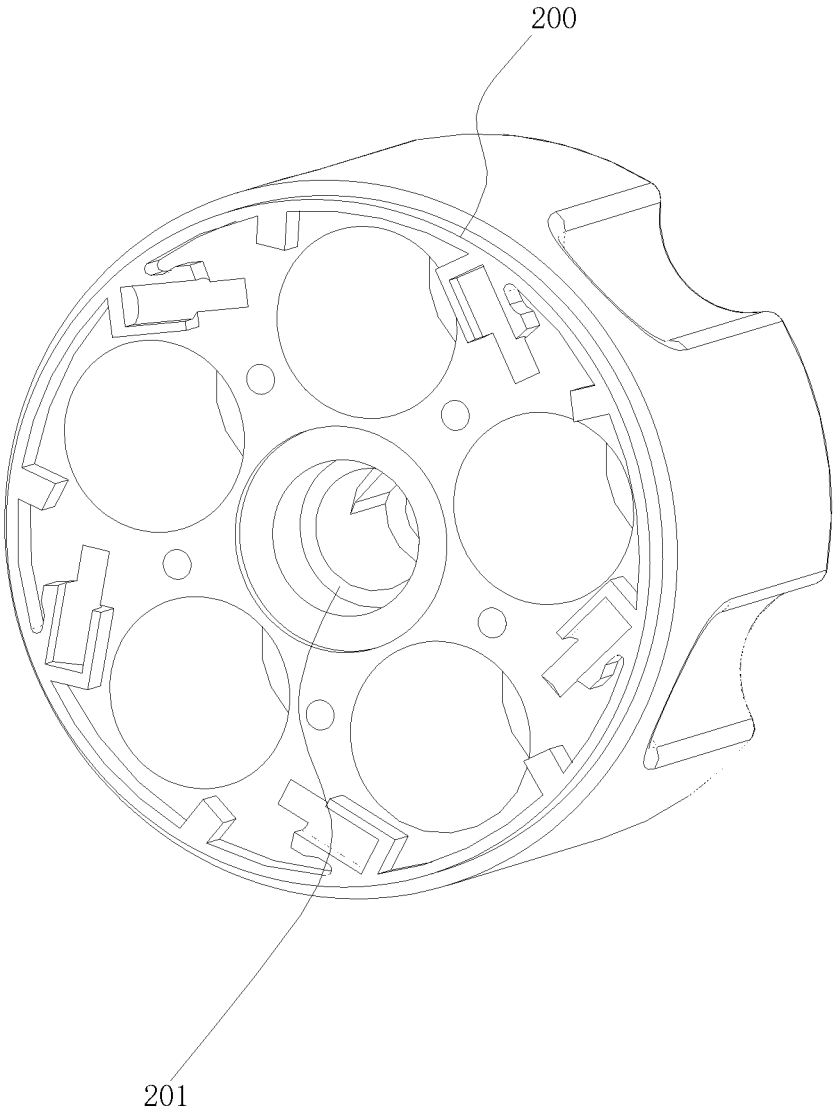
FIG. 7 is a structural schematic diagram of a balance weight seat of the portable dumbbell of one embodiment of the present disclosure of FIG. 1.

As shown in FIGS. 5 and 7, further, in order to restore the rotary switch 301 automatically more quickly, the balance weight lock structure 300 further includes a second elastic member 309, a limiting part 201 is arranged on the balance weight seat 200, and the second elastic member 309 is sleeved on the connection rod 120 and abuts against the limiting part 201 of the balance weight seat 200 and the rotary switch 301 respectively.

When the balance weight 400 needs to be taken out from the assembly hole 210, the rotary switch 301 is moved to the preset position towards a direction of the balance weight 400, the second elastic member 309 deforms due to joint action force of the limiting part 201 and the rotary switch 301, after the rotary switch 301 is rotated to reach the preset angle, the weight fastener 303 is separated from the groove 401 of the balance weight 400 to eject the balance weight 400, and then the balance weight 400 is taken out, the first elastic member 304 recovers from the deformation to recover the weight fastener 303 to a first preset position, such that the rotary switch 301 recovers to a second preset position, and the second elastic member 309 recovers from the deformation to recover the rotary switch 301 to an initial position.

In this way, an arrangement of the second elastic member 309 enables the rotary switch 301 to automatically recover to the initial position, such that use efficiency of the dumbbell is higher.

Further, in order to control a rotation angle of the rotary switch 301 better, the balance weight lock structure 300 further includes a limiting column 310, a first gap 3012 is provided on the rotary switch 301, and the limiting column 310 is fixedly or detachably mounted on the balance weight seat 200 and is accommodated inside the first gap 3012.

In this way, when the rotary switch 301 is rotated, due to existence of the limiting column 310, the rotation angle and a rotation direction of the rotary switch 301 are well limited, and the situation that some parts of the dumbbell are damaged or a function may not be used normally due to the excessive rotation angle or the wrong rotation direction is avoided, such that the dumbbell may be used simply and conveniently for a long time.

Further, in order to take the balance weight 400 out from the assembly hole 210 conveniently, the portable dumbbell further includes a third elastic member 402, where the third elastic member 402 is fixedly mounted on the balance weight seat 200 and abuts against one end of the balance weight 400.

When the balance weight 400 is assembled, the balance weight 400 is mounted into the assembly hole 210, one end of the balance weight abuts against the third elastic member 402, the balance weight lock structure 300 locks the balance weight 400 in the assembly hole 210, the third elastic member 402 is compressed, when the balance weight 400 needs to be replaced, the rotary switch 301 rotates by the first preset angle clockwise or anticlockwise, the stop block 3011 on the rotary switch 301 rotates by the first preset angle at the same time, thereby driving the end of the fastener 303 close to the rotary switch 301 to rotate to make the other end of the fastener 303 away from the groove 401 of the balance weight 400 until the weight fastener 303 is separated from the groove 401 so as to take the balance weight 400 out from the assembly hole 210, the third elastic member 402 recovers from the deformation to eject the balance weight 400 from the assembly hole 210.

In this way, by means of the arrangement of the third elastic member 402, when the balance weight lock structure 300 is removed from the balance weight 400, the balance weight 400 is ejected from the assembly hole 210 to make the balance weight 400 taken out from the assembly hole 210 conveniently.

Figure 6:
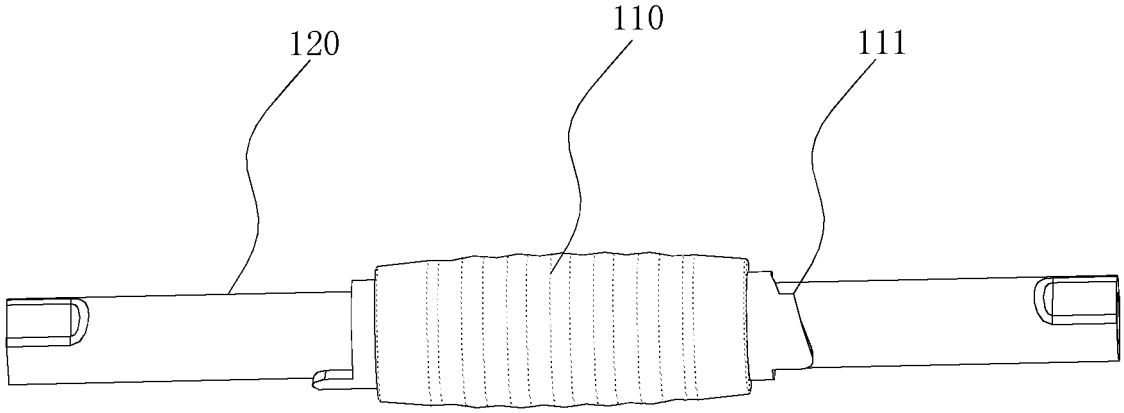
FIG. 6 is a structural schematic diagram of a handle connection rod of the portable dumbbell of one embodiment of the present disclosure of FIG. 1.

As shown in FIG. 6, further, in order to prevent the rotary switch 301 from rotating by mistake to unlock the balance weight, two ends of the handle 110 are provided with a second gap 111 respectively, and a third gap matching the second gap is provided on an inner layer of the rotary switch 301.

In this way, the second gap 111 and the third gap are arranged to match each other, when fitness training with the dumbbell is carried out, the second gap 111 is in joint with the third gap together in a clamped manner to make the rotary switch 301 unable to rotate freely, such that the situation that in a process of body building exercise with the dumbbell, the rotary switch 301 rotates by mistake to unlock the balance weight, and then the balance weight 400 falls out from the assembly hole 210, causing personal injury or facility damage is avoided.

Further, the balance weight seat 200 is of at least one of a spherical structure, a cylindrical structure and a polygonal structure.

Various technical features of the embodiments mentioned above may be arbitrarily combined. To simplify description, all possible combinations of the various technical features of the embodiments mentioned above are not described. However, if only the combinations of these technical features do not conflict, they shall be considered to be within the scope of description of the present disclosure.

The embodiments mentioned above are merely several embodiments of the present disclosure, and are specifically described in details, but may not be interpreted as limiting the scope of the patent for the disclosure as a result. It shall be noted that for those of ordinary skill in the field, they may also make several transformations and improvements on the premise of not deviating from the conception of the present disclosure, and these transformations and improvements shall fall within the scope of protection of the present disclosure. Hence, the scope of protection of the patent for the present disclosure shall be subject to the appended claims.

What is claimed is:

1. A portable dumbbell, comprising a handle connection rod, a balance weight seat, a balance weight lock structure and a balance weight, wherein the handle connection rod comprises a handle and a connection rod, the handle being fixedly or detachably mounted on the connection rod, the balance weight seat is fixedly or detachably mounted at an end of the connection rod, at least one assembly hole is provided on the balance weight seat and used for assembling the balance weight, and the balance weight lock structure is fixedly or detachably mounted at the end of the connection rod, is partially accommodated inside the balance weight seat, and is used for controlling the balance weight to be rapidly mounted and locked and unlocked and taken out;

the balance weight lock structure comprises a rotary switch, a fixed shaft, a weight fastener and a first elastic member; a stop block is arranged on the rotary switch; the rotary switch is sleeved on the end of the connection rod; the fixed shaft is fixedly mounted on the balance weight seat; the weight fastener is mounted on the fixed shaft; one end of the weight fastener abuts against the stop block; one end of the first elastic member is mounted on the weight fastener, and the other end of the first elastic member abuts against an inner layer of the balance weight seat.

2. The portable dumbbell according to claim 1, wherein one end of the balance weight is provided with a groove, and an end of the balance weight close to the handle is of a cambered surface structure or an inclined surface structure.

3. The portable dumbbell according to claim 1, wherein a side of the weight fastener away from the first elastic member is of an inclined surface structure or a cambered surface structure.

4. The portable dumbbell according to claim 1, wherein the balance weight lock structure further comprises a second elastic member, a limiting part is arranged on the balance weight seat, and the second elastic member is sleeved on the connection rod and abuts against the limiting part of the balance weight seat and the rotary switch respectively.

5. The portable dumbbell according to claim 1, wherein the balance weight lock structure further comprises a limiting column, a first gap is provided on the rotary switch, and the limiting column is fixedly or detachably mounted on the balance weight seat and is accommodated inside the first gap.

6. The portable dumbbell according to claim 1, further comprising a third elastic member, wherein the third elastic member is fixedly mounted on the balance weight seat and abuts against one end of the balance weight.

7. The portable dumbbell according to claim 1, wherein the balance weight seat is of at least one of a spherical structure, a cylindrical structure or a polygonal structure.

* * * * *